United States Patent [19]

Stockman

[11] 4,405,011

[45] Sep. 20, 1983

[54] ELEMENT BASKET

[75] Inventor: Richard F. Stockman, Friendship, N.Y.

[73] Assignee: The Air Preheater Company, Inc., Wellsville, N.Y.

[21] Appl. No.: 306,554

[22] Filed: Sep. 28, 1981

[51] Int. Cl.[3] ..... F28D 19/00

[52] U.S. Cl. ..... 165/10; 29/157.3 R

[58] Field of Search ..... 165/9, 10; 29/157.3 R

[56] References Cited

U.S. PATENT DOCUMENTS

| | | | |
|---|---|---|---|
| 2,432,198 | 12/1947 | Karlsson et al. | 165/10 |
| 2,558,752 | 7/1951 | Holm | 165/10 X |
| 3,372,736 | 3/1968 | Brandt et al. | 165/10 |
| 3,379,240 | 4/1968 | Woolard et al. | 165/10 |
| 3,465,815 | 9/1969 | Wheeler | 165/10 |

*Primary Examiner*—Albert W. Davis, Jr.

*Attorney, Agent, or Firm*—William W. Habelt

[57] ABSTRACT

An open ended basket 20 that contains a mass of heat absorbent material for a rotor of a rotary regenerative heat exchange apparatus. The basket has a uniquely curved support bar 26 at opposite ends thereof adapted to extend obliquely across the mass of heat absorbent material. The support bar is of greater length than the distance between parallel walls of the basket whereby varying the angle at which the support bars extend obliquely away from the contacting walls, each support bar may be made to fit exactly between parallel walls.

4 Claims, 6 Drawing Figures

ELEMENT BASKET

BACKGROUND OF THE INVENTION

The present invention relates to an element basket or container for a mass of heat absorbent plates as carried in a rotary regenerative heat exchanger. More particularly, the present invention relates to a specific basket structure that provides for an element basket of maximum strength and rigidity, and one that has a basic design that permits it to be economically and quickly produced with a minimum of materials and labor.

DESCRIPTION OF THE PRIOR ART

In various applications utilizing rotary regenerative heat exchange apparatus, the heat absorbent material thereof is contained in frames known as "baskets" that are modular in form and portable in the manner shown by U.S. Pat. Nos. 2,432,198 and 3,605,874. Each basket comprises essentially an enclosure for the heat absorbent element that is formed of imperforate plate, said enclosure having open ends that permit the flow of gas and air therethrough in accordance with standard practice.

The baskets are formed according to various procedures which best suit the size and design of the basket and the type of heat absorbent element to be packed therein. Inasmuch as the manufacturing of a basket includes many variable factors usually lacking in quality control, the characteristics of a completed basket may vary considerably. Since the baskets normally contain element plates packed to various degrees of tightness, the side walls of each basket may bulge or bend, and the overall size of each basket may vary considerably. To hold the element plates tightly within the basket, radial support bars are secured to the radially opposite inner and outer ends of each basket. These support bars are designed to hold the element plates firmly in position without causing excessive resistance to fluid such as gas and air flowing through the rotor.

The radial support bars are usually straight bars precut to a predetermined length. During assembly thereof, the support bars are frequently found to be too short or too long to readily fit into the basket structures so they require bending the basket walls in or out and thereby deforming the basket. Thus, a completed element basket is frequently too large or too small to fit effectively into its allotted space, or it may be warped and twisted so adjacent baskets fail to closely abut one another, thus permitting fluid flow therebetween and a general lowering of the effectiveness of the heat exchanger.

SUMMARY OF THE INVENTION

The present invention is accordingly directed to an open ended basket for heat absorbent material in regenerative heat exchange apparatus.

More particularly, the present invention relates to a basket for the rotor of a rotary regenerative heat exchanger in which element support means at opposite ends of each basket comprise an elongate bar formed into a curved or "V" shaped configuration with an arm thereof extending obliquely from an end wall of the basket to another end wall spaced parallel thereto. If the support means is too short to extend between parallel walls of the basket, or if it is too long to fit between opposite sides thereof, the angle at which the oblique arms extend outwardly may be varied as deemed necessary whereby they will extend exactly from one side of the element basket to the opposite side thereof. Furthermore, by using a formed support bar bent to induce a spring action, a single elongate structural member may be used thereby eliminating an excessive number of separate parts, shortening the construction time, and forming a more perfect basket whose arms always fit.

BRIEF DESCRIPTION OF THE DRAWING

A more complete understanding of my invention may be realized by referring to the following description as it is viewed in conjunction with the accompanying drawing in which.

DESCRIPTION OF THE PREFERRED EMBODIMENT

Figure 1:
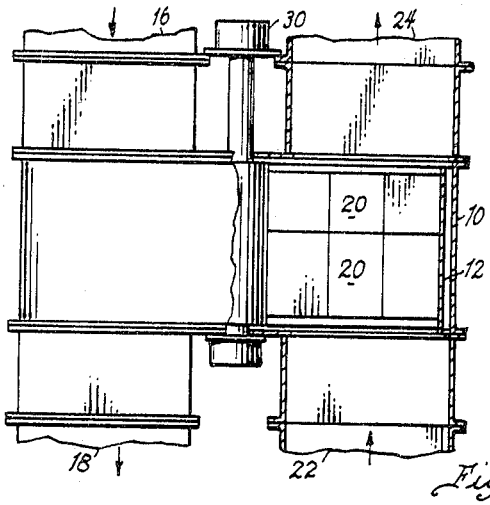
FIG. 1 is a sectional view of a rotary regenerative heat exchanger.
Figure 2:
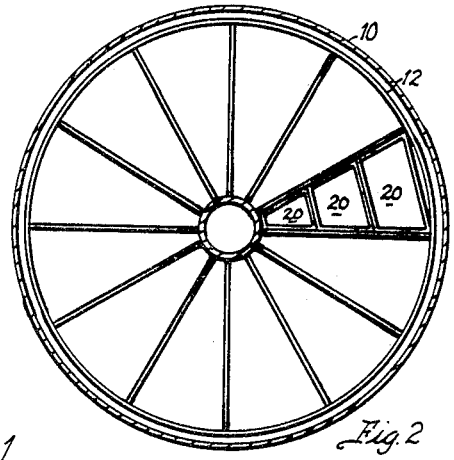
FIG. 2 is a plan view of the rotor.

As illustrated in the drawing, a housing 10 encloses a rotor having a rotor shell 12 containing a mass of heat absorbent material in the form of plates 14 that are contacted by a stream of hot air or other hot gas entering the housing through an inlet duct 16 and being exhausted to an outlet duct 18 after having traversed the heat exchange material in the compartments of the rotor that lie therebetween. Cool air or other gas entering the housing through an inlet 22 is also exhausted to outlet duct 24 after having traversed the heat absorbent material contained by the rotor. While gas and air are being directed through their particular passageways of the rotor, the rotor is being continuously rotated about its central axis by a drive means 30 in order that each part of the heat exchange element contained in the rotor may be alternately aligned by the hot gas and cool air ducts whereby the heat of the hot gas is continuously transmitted to the cooler air.

The heat exchange material carried by the rotor comprises essentially a mass of heat absorbent plates 14 having spacers provided to form passageways therebetween for the flow of the several fluids. The plates 14 are usually disposed circumferentially and packed in an enclosure or basket 20 that firmly holds the plates in a predetermined relationship whereby said plates may be handled together as a modular unit for loading, servicing or replacement.

Each basket 20 comprises an open ended metallic frame including two parallel end walls joined by radial side walls to form a trapezoidal shaped enclosure. The basket may be comprised of a single elongate metallic strip bent in accordance with size requirements, or it may be built up from elemental side pieces welded to corner sections and reinforcement strips. However, the exact construction of the basket frame is not germane to this invention, and the support bars thereof may be applied to any type of enclosure.

Each frame-like basket 20 carries a plurality of packed plates 14. The plates 14 are usually disposed parallel to the end walls of the basket, and a support bar or grid 24 is placed across the open ends of the basket to hold the element in the basket when it is being moved or otherwise being subjected to an outside force that would normally eject the element plates therefrom.

The usual element support bars are formed by welding radially extending bars between the inner faces of parallel end walls. However, as previously explained, these bars are frequently too short or too long so that they necessitate extensive deformation of the basket walls, shortening of the rods, or extensive welding to properly place and affix them to the basket walls, a process which is both time consuming and excessively expensive.

Figure 3:
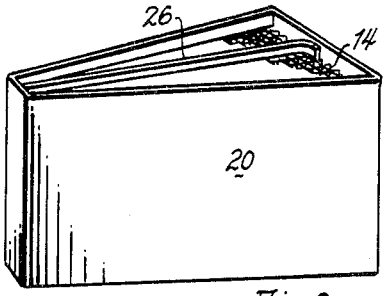
FIG. 3 is a perspective view of an element basket having a single support bar with a curved end.
Figure 4:
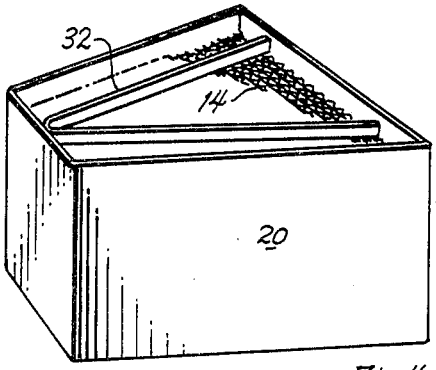
FIG. 4 is a perspective view of an element basket having a "V" shaped element support bar.
Figure 5:
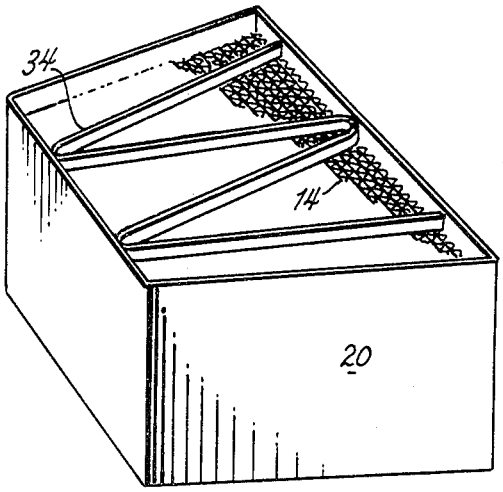
FIG. 5 is a perspective view of an element basket having a "W" shaped element support bar.

In accordance with this invention, a support bar 26 comprising an elongate bar with one or more curved ends is positioned across the open ends of each basket. In its simplest form, the support bar 26 is an essentially straight bar with a curved end which must be held in contact with the basket walls. When held against the walls it is welded thereto to provide a support at each end of enclosed elements plates as shown by FIG. 3. In a more developed form, the support means is formed into a "V" shaped bar 32 with straight arms thereof adapted to extend obliquely outward from a common curved portion or bight. In a still more developed form, the support means comprises a "W" or multiple "V" configuration 34 similar to that shown in FIG. 5 of the drawing.

Figure 6:
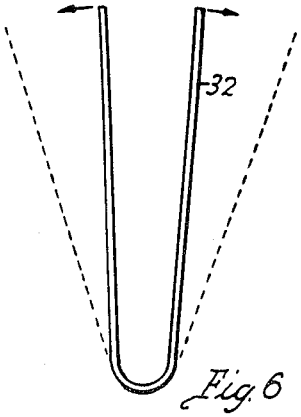
FIG. 6 is a view of an element support bar illustrating the reduction in amplitude of the support bar when the arms thereof are spread apart.

As shown in FIG. 6 of the drawing, the support means is initially formed into a configuration having substantially closed arms which lie at opposite ends of a bight and in nearly parallel relationship. As the arms are spread apart, the amplitude of the support means decreases and a spring action is generated at the bight thereof. This spring action will cause the arms thereof to be biased back toward a closed position where the support means has maximum amplitude. As the arms of the support means are spread apart, said support means may accordingly be inserted between parallel basket end plates and across the ends of the element plates therein. Then, when the arms are set free, they will spring back to immediately increase the distance between their radial extremities and thereby contact the end walls of the basket. Then a simple tack weld between each end of a support bar and the abutting basket wall is sufficient to maintain it in a permanent position that holds the element sheets in the basket without deforming the basket walls.

I claim:

1. An element pack for a regenerative heat exchanger including a plurality of element sheets lying in lateral juxtaposition and spaced apart to permit the flow of fluid therethrough, an open ended basket enclosing the element sheets, said open ended basket including a pair of parallel walls lying parallel to the element sheets and spaced apart to bracket the element sheets therebetween, and an element support means lying at opposite ends of the element basket adapted to hold the element sheets firmly in the basket, said support means comprising a flexible bar having a curved portion forming a variable bight at an end of plural straight portions and disposed such that the curved portion abuts one wall of said pair of parallel walls and the straight portions extend obliquely across an end of the element basket to abut the opposite wall of said pair of parallel walls thereby supporting the element sheets within the basket.

2. An element pack for a regenerative heat exchanger as defined in claim 1 wherein the longitudinal axis of the curved support means lies parallel to the end of the rotor.

3. An element pack for a regenerative heat exchanger as defined in claim 1 wherein the length of the support means at opposite ends of the open ended basket exceeds the perpendicular distance between end walls of the basket.

4. An element pack for a regenerative heat exchanger as defined in claim 1 wherein said support means has a "W" shaped configuration.

* * * * *